United States Patent [19]

Chang

[11] 4,338,125

[45] * Jul. 6, 1982

[54] METHOD FOR THE PREPARATION OF URANIUM COMPOUNDS VIA ELECTROLYTIC AMALGAMATION OF URANIUM ION DIRECTLY FROM AN AQUEOUS SOLUTION

[75] Inventor: Chau-Ting Chang, Hsin Chu, Taiwan

[73] Assignee: Institute of Nuclear Energy Research, Taiwan

[ * ] Notice: The portion of the term of this patent subsequent to Jan. 25, 1994, has been disclaimed.

[21] Appl. No.: 70,417

[22] Filed: Aug. 28, 1979

Related U.S. Application Data

[63] Continuation of Ser. No. 940,590, Sep. 8, 1978, abandoned, which is a continuation of Ser. No. 707,706, Jul. 22, 1976, abandoned, which is a continuation-in-part of Ser. No. 614,479, Oct. 15, 1974, Pat. No. 4,004,987.

[51] Int. Cl.[3] ..... C22B 60/02

[52] U.S. Cl. ..... 75/84; 75/122.7; 75/84.1 R; 75/122.5; 423/256; 423/261; 423/254; 204/124; 204/1.5

[58] Field of Search ..... 75/84, 122.7, 84.1, 75/169; 423/256, 261, 254; 204/124, 1.5

[56] References Cited

U.S. PATENT DOCUMENTS 2,865,737 12/1958 Blanco et al. ..... 75/84.1
2,956,872 10/1960 Avery ..... 75/84.1
3,272,601 9/1966 Hansen ..... 423/256 X
4,004,987 1/1977 Chang ..... 204/1.5

OTHER PUBLICATIONS

Lee, H. C. et al., "Electrolytic Amalgamation of Uranium Using an Ion Exchange Membrane", J.C.S. Chem. Comm. 1975, p. 124.

Nuclear Science Abstract, 16:14810, Jun. 1962.

Belle, J. Ed., Uranium Dioxide: Properties and Nuclear Applications, USAEC, 1961.

Seaborg, G. T., "The Actinide Series", in *Comprehensive Inorganic Chem.,* vol. 1, Van Nostrand Co., Princeton, 1953, pp. 192–193.

*Primary Examiner*—Brooks H. Hunt

*Attorney, Agent, or Firm*—Burns, Doane, Swecker & Mathis

[57] ABSTRACT

The preparation of nuclear fuels such as uranium dioxide, carbide and nitride employing the ammonium urante, $(NH_4)_2U_2O_7$, as starting material usually must undergo a series of chemical and metallurgical processes at relatively high temperature and under strictly controlled working condition.

A simple method for the preparation of these nuclear fuels has evolved with respect to the electrolytic amalgamation of uranium ion directly from an aqueous solution. The thereby obtained uranium amalgam maybe thermally decomposed into a fine metallic powder which reacts readily with water vapor, methane and nitrogen gas to bring forth uranium dioxide, carbide and nitride, respectively.

10 Claims, No Drawings

METHOD FOR THE PREPARATION OF URANIUM COMPOUNDS VIA ELECTROLYTIC AMALGAMATION OF URANIUM ION DIRECTLY FROM AN AQUEOUS SOLUTION

CROSS-REFERENCE TO RELATED APPLICATIONS

This application is a continuation of application Ser. No. 940,590, filed Sept. 8, 1978, now abandoned, which is a continuation of application Ser. No. 707,706, filed July 22, 1976, now abandoned, which is a continuation-in-part of application Ser. No. 614,479, filed Oct. 15, 1974, now U.S. Pat. No. 4,004,987.

FIELD OF INVENTION

A simple method for the preparation of uranium dioxide, carbide and nitride has been developed. The invention relates to the thermal decomposition and subsequent reaction of uranium amalgam with water vapor, methane and nitrogen respectively under less strictly controlled conditions for the respective materials. In the copending application of Chau-Ting Chang, Ser. No. 514,479, filed Oct. 15, 1974, now U.S. Pat. No. 4,004,987, there is disclosed the preparative method for the uranium amalgam.

The present invention has greatly simplified the existing method comprising of tedious chemical and metallurgical processes and, at the same time, greatly reduced the overall power consumption. It is to be pointed out that a more meaningful and economical production of uranium metal and its compounds becomes possible with the successful preparation of the solid uranium amalgam directly from an aqueous solution. Moreover, the invention might find a wide application in the preparation of various metals and their compounds directly from their aqueous solutions without recourse to conventional methods.

BACKGROUND OF INVENTION

The preparation of the nuclear fuels such as uranium and its compounds starting from the yellow cake or ammonium uranate, $(NH_4)_2U_2O_7$, usually follows a series of chemical and metallurgical processes at relatively high temperature and under strictly controlled experimental conditions. The flow-sheet of the overall processes for $UO_2$, UC and $U_2N_3$ are shown diagrammatically as follows.

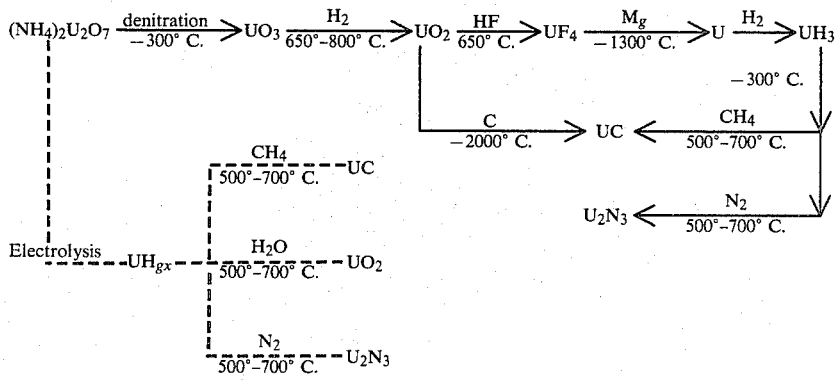

where the solid lines indicate the conventional processes, while the dotted lines show the reaction paths developed in the present invention.

Taking uranium dioxide as an example, the conventional method comprises denitration and subsequent hydrogen reduction and gives forth to a uranium dioxide which is often found to be nonstoichiometric, strict control of the reaction temperature, grain size of $UO_3$, composition and flow rate of the reacting gas etc. is therefore necessary. In contrary, a stoichiometric uranium dioxide could easily be obtained by reacting uranium amalgam with water vapor within a wide temperature range of 500°-700° C.

Taking uranium carbide as the second example, the conventional method of reacting uranium dioxide and graphite powder, both in solid form, necessitates a very high reaction temperature well above 2000° C. Moreover the involved phase separation after the reaction renders the stoichiometricity of the product difficult. Another gas-solid reaction process involving a fine uranium powder and methane is seldom adopted, because of the tedious process to obtain the uranium powder. In the present invention the chemically active uranium powder obtained from the decomposition of uranium amalgam reacts readily within a wide temperature range of 500°-700° C. to form a stoichiometric uranium monocarbide, UC, as identified with x-ray diffractometry and density measurement. However, it must be pointed out that at a temperature higher than 700° C., uranium dicarbide, $UC_2$, was observed in the product.

Taking uranium nitride as the third example, although the applicability of this compound as a nuclear fuel is limited, it is to show that the chemically active uranium powder obtained from the uranium analgam even reacts with the chemically inert nitrogen within the same temperature range to form uranium nitride with a chemical formula of $U_2N_3$. It has further been observed that this compound decomposes into UN at a temperature higher than 1000° C.

The overall process for the above mentioned compounds will thus be sgreatly simplified as compared with the conventional chemical and metallurgical process and ensure an economical advantages by greatly reducing power consumption and initial costs for the set-up.

SUMMARY OF THE INVENTION

The main object of the present invention is to provide a new method for the preparation of uranium dioxide, uranium carbide and uranium nitride by reacting uranium amalgam respectively with water vapor, methane and nitrogen at a relatively low temperature range. The overall process of the present invention for the preparation of uranium carbide, uranium dioxide and uranium nitride with the yellow cake or ammonium uranate, $(NH_4)_2U_2O_7$, as the starting material greatly simplifies the existing chemical and metallurgical processes and is economically advantageous for its reduced power consumption and initial costs.

Other objects and features of the present invention will become apparent from the following detailed description.

DETAILED DESCRIPTION OF THE INVENTION

The preparation of uranium amalgam in solid form has been fully described in the copending patent application of the same applicant. (U.S. Pat. Ser. No. 514,479 filed Oct. 15, 1975, now U.S. Pat. No. 4,004,987.

The method described in U.S. Pat. No. 4,004,987 by which a uranium amalgam may be prepared is briefly summarized as follows. The uranium amalgam is prepared using an ion exchange membrane for the purpose of adjusting acidity (i.e., pH) during the course of the electrolysis. The electrolytic cell comprises two main compartments (i.e., anode and cathode compartments) divided by an ion exchange membrane. The amalgamation takes place in a mercury-cathode compartment where hydrogen ions are consumed. However, these ions will be continuously supplied through the ion exchange membrane from the anode compartment. The pH of the electrolytic solution is thus kept constant. The amalgam obtained thereby may then be thermally decomposed under reduced pressure and/or in an inert gas atmosphere to yield the uranium powder.

The thermal decomposition of the uranium and the subsequent syntheses of the uranium compounds were carried out first in vacuo and then, in the same set-up, under respective gases kept at 1 atmospheric pressure. The whole system was completely sealed off from the intrusion of the atmospheric air. All gases were chemically treated in order to remove traces of moisture, carbon dioxide and oxygen before use. Before each experiment the system was evacuated down to $10^{-4}$ torr and then flushed with the purified gas. The mercury was condensed and collected with a vessel. The invention is illustrated by the following examples, to which it is not limited.

EXAMPLE 1

The uranium amalgam was thoroughly washed with dil. HCl and deionized water before heating at reduced pressure at ca, 300° C., to distil off the mercury. The thereby obtained fine uranium powder is pyrophoric and burned vigorously in the air into $U_3O_8$.

The same uranium was reacted with a water vapor carried with argon in the same reaction chamber and heated up to 500°-700° C. $UO_2$ without detectable amount of $UO_3$ was obtained.

EXAMPLE 2

The same uranium amalgam was decomposed and treated with methane while heating up to within 500°-700° C. for 2 hrs. Carbon monocarbide was obtained. Detectable amount of uranium dicarbide, $UC_2$, was observed, if the temperature exceeded 800° C.

EXAMPLE 3

The same uranium amalgam was decomposed and treated with nitrogen while heating up to within 500°-700° C. for 2 hrs. The nitride $U_2N_3$ was obtained. This compound was observed to decompose into UN, if the temperature exceeded 900° C.

I claim:

1. A method for the preparation of a uranium compound selected from the group consisting of uranium monocarbide, uranium dioxide and uranium nitride which comprises amalgamating uranium electrolytically from an aqueous solution in a cell having two compartments with an ion exchange membrane in between for the purpose of adjusting the pH during the course of the electrolysis, thermally decomposing the electrolytically obtained uranium amalgam in a vacuum or in an inert gas atmosphere and subsequently or simultaneously reacting the thermally decomposed electrolytically obtained uranium amalgam with a gas selected from methane, water vapor and nitrogen at a temperature below 1200° C. to form the desired compound.

2. The method of claim 1 wherein said reaction is performed at a temperature of between 500° and 700° C.

3. The method of claim 1 wherein said thermally decomposed electrolytically obtained uranium amalgam is reacted with methane to form uranium monocarbide.

4. The method of claim 1 wherein said thermally decomposed electrolytically obtained uranium amalgam is reacted with water vapor to form uranium dioxide.

5. The method of claim 1 wherein said thermally decomposed electrolytically obtained uranium amalgam is reacted with nitrogen to form uranium nitride.

6. The method of claim 1 wherein said reaction is performed simultaneously with the thermal decomposition of the electrolytically obtained uranium amalgam.

7. The method of claim 1 wherein said reaction is performed subsequently to the thermal decomposition of the electrolytically obtained uranium amalgam.

8. In a method for the preparation of uranium monocarbide by the reaction of uranium with methane, the improvement which comprises utilizing as the uranium reactant, uranium formed by the thermal decomposition of a uranium amalgam electrolytically obtained from an aqueous solution in a cell having two compartments with an ion exchange membrane in between for the purpose of adjusting the pH during the course of the electrolysis.

9. In a method for the preparation of uranium dioxide by the reaction of water vapor with uranium, the improvement which comprises utilizing as the uranium reactant, uranium formed by the thermal decomposition of a uranium amalgam electrolytically obtained from an aqueous solution in a cell having two compartments with an ion exchange membrane in between for the purpose of adjusting the pH during the course of the electrolysis.

10. In a method for the preparation of uranium nitride by the reaction of nitrogen with uranium, the improvement which comprises utilizing as the uranium reactant, uranium formed by the thermal decomposition of a uranium amalgam electrolytically obtained from an aqueous solution in a cell having two compartments with an ion exchange membrane in between for the purpose of adjusting the pH during the course of the electrolysis.

* * * * *